United States Patent [19]

Prehodka

[11] 4,386,777

[45] Jun. 7, 1983

[54] TOY VEHICLE RACING GAME

[75] Inventor: Barry V. Prehodka, Ridgefield, Conn.

[73] Assignee: Aurora Products Canada Limited, Mississauga, Canada

[21] Appl. No.: 360,527

[22] Filed: Mar. 22, 1982

[51] Int. Cl.[3] ..... A63F 9/14; A63H 18/04; A63H 18/12

[52] U.S. Cl. ..... 273/86 B; 46/259; 238/10 F

[58] Field of Search ..... 273/86 B; 46/238, 257, 46/258, 259, 260, 261; 238/10 R, 10 E, 10 F

[56] References Cited

U.S. PATENT DOCUMENTS

| | | | |
|---|---|---|---|
| 2,691,946 | 10/1954 | Marmo | 104/148 |
| 2,895,429 | 7/1959 | Baermann | 105/77 |
| 2,903,821 | 9/1959 | Favre | 46/236 |
| 3,299,565 | 1/1967 | Yarashes | 46/235 |
| 3,451,161 | 6/1969 | Lemelson | 46/241 |
| 3,810,515 | 5/1974 | Ingro | 180/1 VS |
| 3,964,206 | 6/1976 | Bernhard | 46/251 |
| 4,031,660 | 6/1977 | Chen | 46/228 |
| 4,031,661 | 6/1977 | Bernhard | 46/249 |
| 4,055,021 | 10/1977 | Okamoto | 46/202 |
| 4,066,211 | 1/1978 | Mak | 238/10 F |

FOREIGN PATENT DOCUMENTS

| | | | |
|---|---|---|---|
| 537383 | 12/1955 | Italy | 46/238 |

*Primary Examiner*—Anton O. Oechsle

*Attorney, Agent, or Firm*—Blum, Kaplan, Friedman, Silberman & Beran

[57] ABSTRACT

A toy vehicle for a racing game and a track for performance on vertical and horizontal surfaces. The vehicle carries an electric motor and draws power from a pair of conductive rails embedded in the track surface. Increased magnetic attraction between the car and the conductive rails is provided locally to enable the vehicle to ride on vertically extending track lengths without impairing horizontal performance. Increased magnetic coupling is also effective in enhancing vehicle performance on curves. Greater holding forces between vehicle and track on vertical surfaces is provided by increased width in the electrically conductive rails embedded in the track surface.

31 Claims, 7 Drawing Figures

TOY VEHICLE RACING GAME

BACKGROUND OF THE INVENTION

This invention relates generally to toy vehicles of the type used on a track surface having electrical conductors embedded in the surface thereof, and more particularly to toy vehicles and track which permit reliable operation, with good performance on vertical surfaces. The game of driving and racing small electrified toy vehicles on tracks comprising one or more closed continuous loops has become increasingly popular in recent years. Electric motors mounted in the vehicles are energized through conductors or rails imbedded in the surface of the track, and the vehicles may be remotely controlled. Racing of cars on parallel tracks with various cross-overs, bypasses, obstacles, leaps, and the like is very popular. The cars look like racers and stock cars in miniature and generally there is an effort in design of such toys to achieve simulated realism, for example, illuminated head lamps, motor noise simulators, an ability to steer the vehicles and to operate either in the forward or reverse direction. All this is accomplished with control provided by the operator from a remote location.

However, in order to provide a commercially successful product, excitement as well as realism, for the user and spectator is desirable. High rates of acceleration and high speed are factors adding excitement to the game. However, high accelerations are achieved with vehicles of low mass, but low mass may result in wheel slippage under conditions of rapid starting. High velocities when achieved, frequently result in the vehicle leaving the track on entering curves which are a necessary part of a closed loop track circuit. In earlier models of toy vehicles of the prior art, additional weight was used to keep the vehicles on the track at high velocities, especially on curves. Thus, a conflict existed between low weight-high acceleration performance and requirements for successful high speed operation of the vehicles.

This problem has been overcome in the art by providing magnetic attraction between the vehicle and the track such that magnetic force is combined with the weight of the vehicle in providing a strong holding force between the vehicle and track at high speeds, even around curved segments. Acceleration was also improved as wheel traction was enhanced by the magnetic attraction and vehicle weight could be reduced without slip of the wheels at start-up and without the vehicle leaving the track on turns at high speed.

U.S. Pat. No. 4,031,661, issued June 28, 1977, discloses a refined construction of a vehicle having driving and accelerating properties which are enhanced by magnetic attraction to the power rails embedded in the track. Flux collectors on the side of the motor magnets concentrate the flux and direct the flux for cooperation with the rails. This construction improves the track hugging capabilities of the car while not requiring the relatively greater weight of additional magnets. Thus, performance is benefitted during start-up and at high speeds, especially on curved surfaces.

It would be desirable to enhance the play value of road racing sets by providing vertically extending track sections as well as track sections extending horizontally, upside down or along vertical surfaces. However, conventional toy racing sets do not provide for this. However, such a feature should not interfere with normal track operations.

What is needed is a toy vehicle and track having vertical portions which provides excellent performance on the vertical surfaces without relative loss of performance on the horizontal track surfaces.

SUMMARY OF THE INVENTION

Generally speaking, in accordance with the invention, a toy vehicle for a racing game and a track especially suitable for performance on vertical and horizontal surfaces is provided.

The vehicle carries an electric motor and draws power from a pair of conductive rails or strips embedded in the track surface. Increased magnetic attraction between magnetic means on the car and the conductive strips embedded in the track surface is provided locally in a strength sufficient to enable the vehicle to ride on the track surface of vertically extending track lengths without impairing horizontal performance. This increased magnetic coupling is particularly effective in enhancing performance of the vehicle on curves. The performance of the vehicle and the level of magnetic attraction are improved by means of flux collectors located on the sides of the motor magnets and oriented in the direction of the conductors embedded in the track. Such a construction is described in detail in the above-mentioned U.S. Pat. No. 4,031,661 which is incorporated herein by reference.

The requirements for greater holding forces between the vehicle and the track on vertical surfaces is met by an increased width in the electrically conductive rails embedded in the track surface. Widening the conductive strips in the track surfaces improves the magnetic flux circuit and improves holding force between the track and the vehicle without increasing the height of the conductive rails above the level of the track surface and without increasing the size, number and weight of the magnets. High levels of performance are achieved on the vertical surface without sacrifice of high level performance on the horizontal surfaces.

Accordingly, it is an object of this invention to provide an improved toy vehicle racing game which allows the vehicle to operate efficiently on a vertical track surface.

Another object of this invention is to provide an improved toy vehicle racing game including vertical track surfaces wherein performance of the vehicle on horizontal track is not adversely affected by the vehicles ability to perform on vertical track.

A further object of this invention is to provide an improved toy vehicle racing game including vertical track surfaces wherein the ratio of magnetic force to vehicle weight optimizes performance on the vertical and horizontal track portions.

Still another object of this invention is to provide an improved toy vehicle racing game which is adapted for vertical track portions by modification to the track rather than to the vehicle.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is has to the following description taken in connection with the accompanying drawings in which.

DESCRIPTION OF THE PREFERRED EMBODIMENTS

Figure 1:
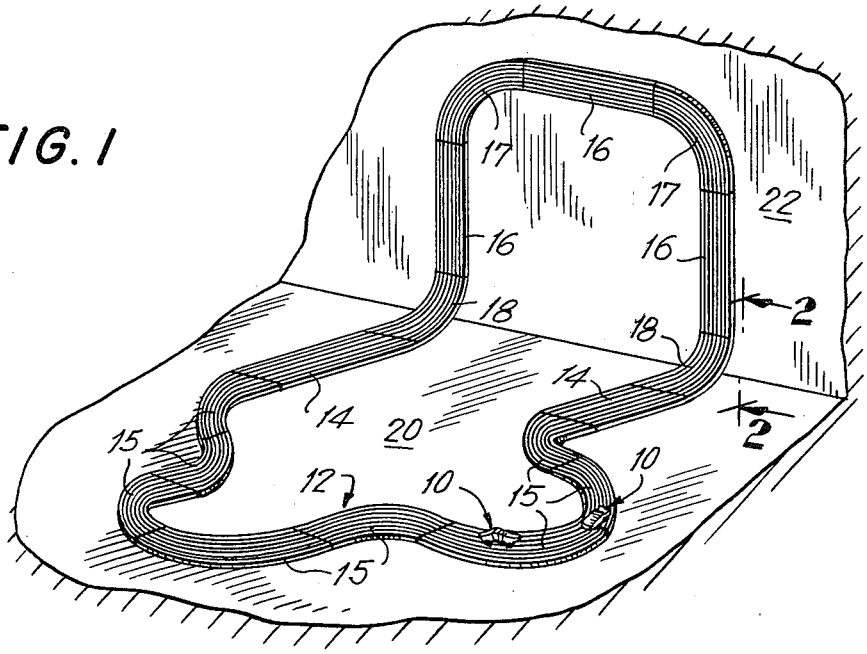
FIG. 1 is perspective view of the toy vehicle racing game including vertical tracks surfaces in accordance with the invention.

With reference to the FIGS. 1-5, a toy vehicle racing game in accordance with the invention includes toy vehicles 10 riding on a track 12 which is comprised of a plurality of interconnected horizontal straight segments 14, horizontal curved segments 15, vertical straight segments 16, vertical curved segments 17 and transitional segments 18. The curved horizontal segments 15 and the curved vertical surfaces 17 bend about axes which are perpendicular to the associated track surface. The transitional segments 18 bend about an axis which is parallel to the track surfaces 20,22. Thus, the transitional segments 18 lead the track from the horizontal to the vertical surfaces and vice versa. The track segments 14–18 are connected together by known connecting means (not shown) to form a closed loop.

The track segments 14–18 are fabricated of plastic or other non-conductive material and include conductive rails or strips 24 which are embedded in the top surface 26 of the vertical segments 16, 17. The rails 24 extend above the surface 26 by a distance Δ. Slots 28, centered between the rails 24, guide the racing vehicles 10 around the track in the known manner. Conductive rails or strips 30 are embedded in the upper surface 32 of the horizontal and transitional segments 14, 15, 18 and rise above the surface 32 by the same distance Δ. The slot 28 continues through all track segments such that when the track loop is partially or completely assembled the top surface 26 is desirably smooth and continuous as are the top surfaces of the rails 24, 30. For purposes explained more fully hereinafter, the width w of the rails 24 on the vertical curved and straight segment 16, 17 is greater than the width w' of the rails 30 on the horizontal and transitional track segments 14, 15, 18.

Figure 2:
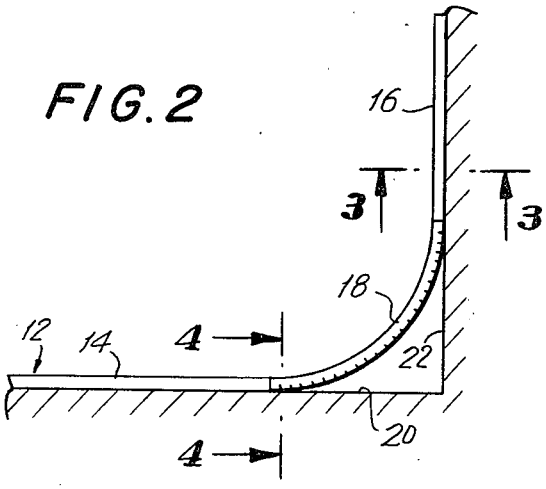
FIG. 2 is a sectional view to an enlarged scale taken along the line 2—2 of FIG. 1.
Figure 3:
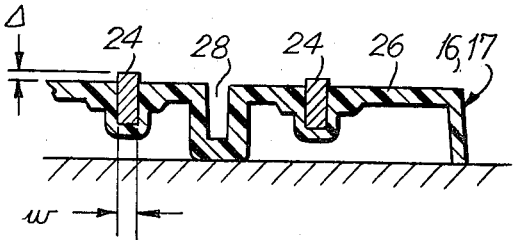
FIG. 3 is a partial sectional view, to a further enlarged scale, taken along the line 3—3 of FIG. 2.
Figure 4:
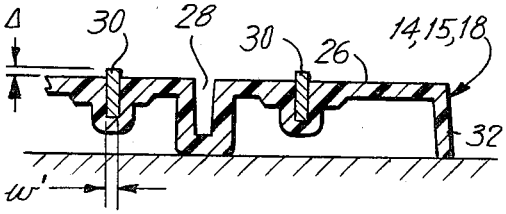
FIG. 4 is a view similar to FIG. 3 taken along the line 4—4 of FIG. 2.
Figure 5:
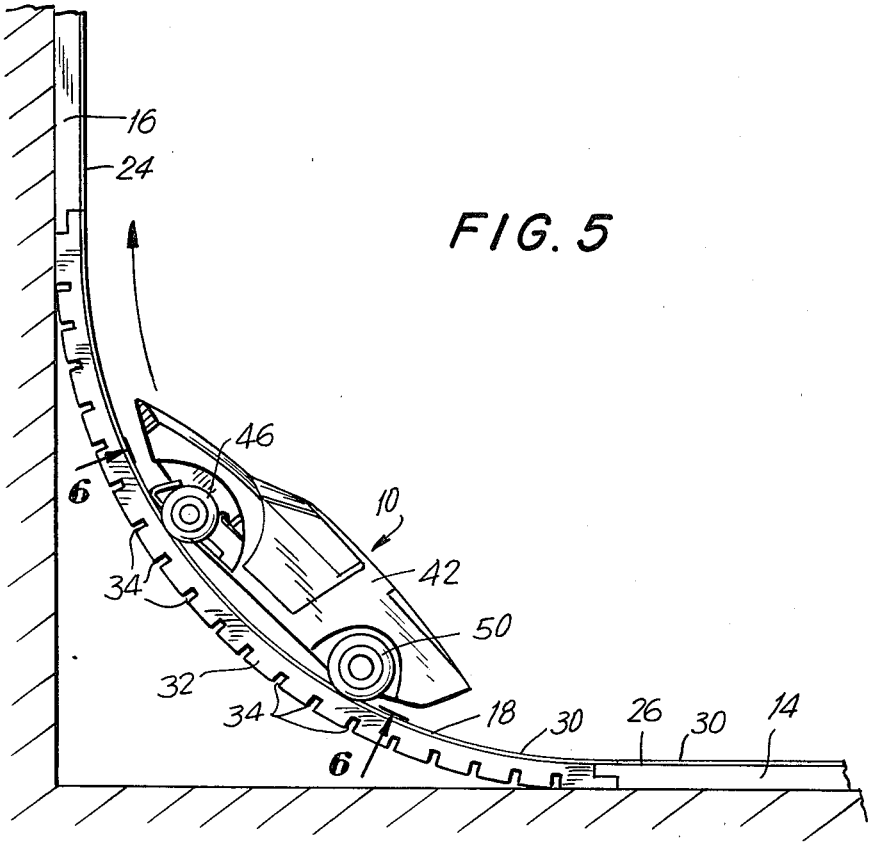
FIG. 5 is a view similar to FIG. 2, to a further enlarged scale, showing a toy vehicle in accordance with the invention in transition between horizontal and vertical travel on the track.

The transition segments 18 provide for a 90 degree bend as best seen in FIGS. 2 and 5. As illustrated, FIG. 1, the track layout is comprised of two lanes, each lane comprising a pair of conductive rails 24,30 with a central slot 28.

Figure 6:
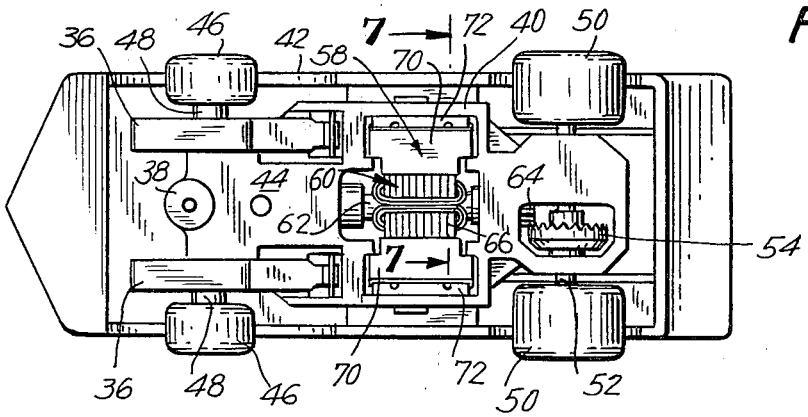
FIG. 6 is a bottom view, to an enlarged scale, taken along the line 6—6 of FIG. 5.
Figure 7:
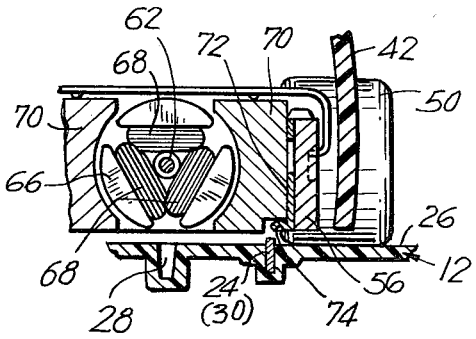
FIG. 7 is a partial sectional view taken along the line 7—7 of FIG. 6.

With reference to FIGS. 5-7, the vehicle 10 includes a pair of pick-up shoes 36 extending downward from the bottom of the vehicle 10 which each engage one of the rails 24,30 and remain in sliding contact with the rails as the vehicle moves along the track 12, thereby delivering electric power to the vehicle 10. In the known manner, a guide pin 38 extends downward from the front of the vehicle 10 to engage in the continuous slot 28 between the rails. By this arrangement of guide pin 38 and slot 28, the car 10 is steered through its intended course around the track 12 as the guide pin 38 moves along the slot in both the horizontal, vertical and transitional portions of the track.

The vehicle 10 comprises a supporting chassis 40 and a body shell 42 of any desired configuration, for example, race car, stock car, which is fitted to the chassis 40. The body shell portions which overhang, that is, extend beyond the front and rear wheels 46, 50 are tapered upwardly away from the track surface (FIG. 5), thereby avoiding undesirable contact between the body shell 42 and the transitional track segments 18. The chassis 40, which is preferably made of a sturdy plastic material, includes a floor 44 and a plurality of vertical walls to which other elements of the vehicle are mounted. Specifically, each of the front wheels 46 is rotatably mounted on an independent axle 48 extending laterally from a floor 44 at the front of the vehicle. The guide pin 38 is also mounted at the front of the vehicle 10 between the front wheels 46 by conventional means (not shown), and extends downward below the chassis 40 and into the slot 28 in the track 12. The rear wheels 50, which are of a wide configuration and covered with a foam rubber material having a high coefficient of friction, are coaxially secured to an axle 52 on which a crown gear 54 is fixedly secured between the wheels 50. The axle 52 is journaled in parallel side walls 56 (FIG. 7) at the rear of the vehicle 10.

An electric motor 58 mounted on the chassis 40 receives electric power from the power rails 24, 30 through the shoes 36 and drives the rear wheels 50 to propel the miniature vehicle 10 around the track 12. The electric motor 58 includes an armature assembly 60 which forms the movable component or rotor of the electric motor 58. The armature assembly 60 is coaxially mounted on a drive shaft 62 for rotational movement. The drive shaft 62 is oriented along the length of the vehicle 10 and terminates in a coaxially fixed pinion wheel 64 which meshes with the crown gear 54 to power the rear wheels 50. A shaft 62 is journaled on both sides of the armature 60 in a pair of bearings (not shown). The bearings are made of a material permitting low frictional rotation of the shaft 62, for example, brass bearings.

The armature assembly 60 includes a generally cylindrical core 66 which is comprised, for example, of soft iron laminations. As best seen in FIG. 7, the core 66 is partly cut away to form three core segments each of which is fitted with a winding 68 of insulated wire wound in the conventional fashion for miniature electric motors. A segmented commutator (not shown) is coaxially mounted on the shaft 62 between the front shaft bearings (not shown) and the armature 60. The windings 68 are electrically connected to the commutator in the known manner, and the commutator serves as an electric contact for receiving electrical power to be provided to the windings. Electrical power, as stated above, is provided from the rails 24, 30 to the commutator by means of the contact shoes 36 and a pair of brush assemblies (not shown) which in the conventional manner are electrically connected to the shoes 36 and also make sliding contact with the commutator.

As disclosed in the above-mentioned U.S. Pat. No. 4,031,661, the shoes 36 are contoured and retained in a manner which assures continuous contact between the shoes and the conductive rails 24, 30 while the vehicle 10 is riding on the track 12 with its wheels 46, 50 in contact with the upper track surface 26.

The stationary or stator component of the electric motor 58 comprises a pair of magnet assemblies including magnets 70, each provided with a flux collector 72 and mounted in a bottomless compartment of the chassis 40. A magnet 70 is located on each side of the armature 60 in the known manner. This construction permits the magnet assemblies 70, 72 to extend through the floor of the chassis 40 and to be in close proximity to the rails 24, 30 thereby providing a strong attractive force holding the vehicle 10 to the track 12. Each of the magnets 70 is contained in a compartment formed of walls of the chassis 40. The magnets 70 are identical except that one has its south pole on its inner surface, which is curved to conform with the armature assembly 60, and the north pole at the opposite or outer surface. The other magnet has its poles oppositely oriented. The magnets 70 which are generally rectangular are supported in the chassis compartments in close proximity to the armature 60 (FIG. 7). The flux collectors 72 are preferably made of ferrous sheet material and are mounted between the magnet 70 and the wall 56 opposite the armature 60. The flux collectors are effective to increase substantially the attractive force exerted by the magnets 70 on the rails 24, 30 as explained in detail in the U.S. Pat. No. 4,031,661, incorporated herein by reference.

The attractive force between the track 12 and the vehicle 10 needs to be greater on the vertical surfaces than on the horizontal surfaces if the vehicle 10 is to be maintained in continuous contact with the track 12. In the prior art, when additional attractive force is required between vehicle and track, it is conventional to increase the size or number of the magnets carried by the car or to bring the magnets closer to the conductive rails embedded in the track surface. Heavier magnets adversely affect the ability of the vehicle to accelerate rapidly, and bringing the magnets closer to the conductive rails in the track surface increases the hazard of rubbing contact between the magnet and the rails which results from manufacturing and assembling variances in the track segments with regard to the position and elevation of the conductive rails. Further, higher magnetic forces of attraction between the vehicle and the track increases the coefficient of friction between the foam rubber wheels and the track surface such that there may be difficulty in starting or running a vehicle which has been adapted with stronger magnets or a closer relationship with the track for operation on vertical surfaces. This results from excessive load on the small motor carried by the car.

In the toy vehicle racing game in accordance with the invention, the difficulties in maintaining adequate attraction between the vehicle 10 and the vertical track segments 16, 17, is overcome without adversely affecting vehicle performance on the horizontal track segments 14, 15. This is accomplished by the increased width w of the conductive rails 24 in the vertical track segments 16, 17. The increased width w of the conductor rails 24 provides a lower resistance path for the magnetic flux field which has been concentrated in the flux collectors 72 at flanged lower surfaces 74 thereof, substantially opposing the top of the conductive rail 24 (FIG. 7). Because of this improved magnetic circuit on the vertical track segments, a greater attractive force is provided between the track segments 16, 17 and the vehicle 10 without increasing the size and weight of the magnets 70, and without adversely affecting the performance of the vehicle 10 on the horizontal track portions 14, 15.

The weight of the vehicle 10 on the vertical surfaces acts to cause the vehicle to pivot and fall off the track 16, 17, contrary to conditions on the horizontal track segments 14, 15, where the weight of the vehicle acts downwardly to hold the vehicle 10 on the track. As stated, increasing the width w of the rails 24 increases the magnetic attraction between the vehicle and the wall and the holding force is thereby increased. However, if the attractive force between the vehicle 10 and the track surface 26 reaches a certain level, the vehicle is sluggish in its moving performance and may be unstartable. Also, when the attractive force is minimally efficient to retain the vehicle on vertical track surfaces, the vehicle may fall from the track when very rapid starts are attempted by the application of high voltage. Also, with these minimal holding conditions, the vehicle may fall from the vertical track segments when the power is cut for stopping.

A series of tests were performed to determine what magnetic force is best suited to assure proper performance on vertical surfaces without adverse effects on horizontal surface performance. Track thickness w was varied and measurements were made to determine the force exerted by the fixed-size magnets as rail thickness w was varied for a nominally constant height $\Delta$ of 0.015 inch of the rail above the track surface 26. The maximum instantaneous force required to lift the vehicle from the track surface, horizontally orientated, was measured, and the ability of the vehicle to start and stop on vertical surfaces at varying operating voltages was evaluated empirically. The vehicle weighed approximately 18 grams and had foam rubber tires at the rear of the vehicle, the tires having a diameter of approximately 0.49 inches, and being standard tires as used in the miniature toy vehicle industry for HO scale racing. A success rate in the starting and stopping maneuvers, actually performed on vertical surfaces, reached the level of 80 percent when the rail width w equalled 0.030 inches. The success rate of 80 percent represents performance on the vertical surface, including straight up travel, straight down, around a curve, and horizontally, and is considered to be a commercially viable product performance. When rail height $\Delta$ is a variable, the track width varies inversely. Satisfactory performance was achieved with rail widths w in a range of 0.020 to 0.040 inch and nominal rail height $\Delta$ in a range of 0.012 to 0.020 inch.

Performance on the horizontal track segments 14, 15 is not affected since no changes to a standard toy vehicle of this type have been made in order to achieve successful vertical-surface performance. The track width w' of the horizontal track segments 14, 15, as well as for the transitional segments 18, is 0.015 inches.

Because the weight of the vehicle is a major factor in determining the force required to hold the vehicle on a vertically oriented track, the ratio of required force to vehicle weight indicates whether a commerically viable product will be achieved. The test results indicate that a ratio of magnetic force/vehicle weight of 1.5 to 3.0 will achieve a desired level of performance whereas a greater or lesser ratio results in start-up difficulties, either due to over-friction from the wheels when the force is too high or to spinning of the wheels when the force is too low.

In the embodiment of a toy vehicle racing game in accordance with the invention as described above, the attracting force between the track and the vehicle is increased on the vertical track segments by an increase in the width w of the conductive rails 24 embedded in the track. These rails are also used to deliver electrical power to the motor in the vehicle. Attractive force is increased by a wider rail 24 as a result of the diminished reluctance in the magnetic circuit for the flux of the motor magnets including the flux collectors 72. Accordingly, it should be readily understood that not only track width but any modification to the track of the vertical segments which reduces the reluctance of the magnetic flux circuit, will increase the attractive force between the magnets on the vehicle, whether the magnets be part of the motor or independent magnets.

Thus, for example, the conductive rail, rather than being a flat rod in cross-section (FIGS. 3, 4, 7,) may be, in alternative embodiments, for example, an angle member or L-shaped member with a horizontal flange extending outwardly along the upper track surface 26, for example, extending entirely under the lower flange surface 74 on the flux collectors 72. Further, in alternative embodiments of a toy vehicle racing game in accordance with the invention, magnetic strips or surfaces may be applied to or embedded in the track segments for vertical operation which are not used to conduct electricity for operation of the vehicle motor within the vehicle. Similarly, magnets may be provided in the vehicle which are not also components of the electric motor. All alternative embodiments which provide for a diminished reluctance for magnetic flux and greater attraction between track and vehicle in selected portions of the track are considered to fall within the scope of the invention.

For example, in the embodiment described above with relation to FIG. 1, the increased width w of the rails, with the associated reduced magnetic reluctance path, is included only in the vertical portion of the track circuit. In alternative embodiments of the invention, track segments providing reduced magnetic reluctance may be used in any portion of the track where a greater attraction between track and vehicle is desirable. For example, vehicles moving at high speed on the horizontal track segments tend to spin out and leave the track on the curved segments. A tendency for a vehicle to leave the track on a curve is reduced by reducing the vehicle's velocity as it enters the curve.

Accordingly, in alternative embodiments of the invention, the straight track segments preceding a curve may be constructed with rails 24 of the larger width w, either for the entire length of the straight segment or for any desired portion of the straight segment. In such an embodiment, without any adjustment to the voltage applied to the rails, and consequentially to the electric motor, a vehicle moving on the horizontal surface will automatically slow down before entering the curve. Thus, the track incorporates built-in driving "skill". In alternative embodiments of the invention, the rails 24 having the width w may be used on the first curved track segment of a curved portion of the track 12 in order to slow the vehicle automatically on the curve. Also, track segments having rails totally or partially of the increased width w may be used in S-shaped portions of the track where the radius of curvature shifts from one side of the track to the other.

In further alternative embodiments of a toy vehicle racing game in accordance with the invention, the unequal tendency of speeding vehicles in different lanes to leave the track on curves is reduced. For example, it is common to have a guard rail at the turns which assists in keeping the car in the outside lane of a turn on the track. Thus, the outside vehicle enjoys an advantage not available to the vehicle on the inside lane of the same curve. Hence, a curved track segment with an outer guard rail may include conductive rails 30 of narrower width w' in the outside track adjacent the guard rail and conductive rails 24 with the enlarged width w on the inside track. Thus, the vehicle on the inside track lane is automatically, and without control of the operator, slowed on the curve, and the tendency for vehicles to leave the track may be made more equal regardless of the track lane.

In summary, track segments having a lower magnetic reluctance circuit for the magnetic flux of the magnet means in the vehicle are advantageously used on the vertical surfaces, but also can be advantageously used in many selected locations on the horizontal surface. Further, tracks having multiple lanes may have different degrees of attraction for a vehicle provided in the different lanes.

Further, although in the above description, reluctance of the magnetic circuit is selected by modifying dimensions of the conductive rails, it should be understood that the circuit reluctance can also be modified by adjusting the height $\Delta$ of the rails above the running track surface and the distance of the magnets in the vehicle from the track rails. As stated above, this approach to modifying magnetic circuit reluctance is limited in order to prevent undesirable mechanical contact and interference between the vehicle and the track.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed:

1. In a toy vehicle racing game including a track with magnetically permeable material connected thereto, and a miniature toy vehicle having a plurality of wheels for running on a surface on said track, said vehicle including magnetic means, said magnetic means being attracted to said permeable material of said track, the improvement therein comprising:

a first plurality of releasably couplable track segments positionable on an essentially horizontal supporting surface, a second plurality of releasably couplable track segments positionable in an essentially vertical plane, transitional track segments shaped to provide operative coupling between essentially horizontally and vertically extending track sections, said track segments being joinable together to form at least a portion of a closed loop track, the magnetic reluctance along essentially the entire length of at least one segment in a magnetic circuit including the permeable material connected to at least a first portion of the second plurality of track segments and said magnetic means being less than the magnetic reluctance along essentially the entire length of at least on segment of a similar magnetic circuit formed between said magnetic means and said permeable material connected to at least a first portion of said first plurality of track segments, the attraction between said vehicle and said track varying locally and inversely with said reluctances, the attraction between said vehicle and said first portion of said second plurality of track segments being sufficient to normally hold the vehicle to the track during passage of the vehicle therealong if said first portion were disposed vertically.

2. A toy vehicle racing game as claimed in claim 1, wherein said magnetically permeable material includes rails connected to said running surface.

3. A toy vehicle racing game as claimed in claim 2, wherein said at least first portion of said second plurality of track segments have rails with about twice the thickness of said first portion of rails in said first plurality of track segments, said reluctance varying inversely with said thickness.

4. A toy vehicle racing game as claimed in claim 3, wherein said rails in said at least first portion of said second plurality of track segments have a thickness in a range of 0.020 to 0.040 inch and a normal rail height in a range of 0.012 to 0.020 inch.

5. A toy vehicle racing game as claimed in claim 2 or 4, wherein the rails in said transitional track segments have a thickness substantially equal to the rails in said first portion of said first plurality of track segments.

6. A toy vehicle racing game as claimed in claim 2 or 4, wherein a second portion of first plurality of said track segments in said first plurality of track segments has a magnetic path with reluctance less than the reluctance in said first portion of said first plurality of track segments.

7. A toy vehicle racing game as claimed in claim 6, wherein said second portion of said first plurality of track segments has a magnetic circuit reluctance equal to the magnetic circuit reluctance of said first portion of said second plurality of track segments.

8. A toy vehicle racing game as claimed in claim 7, wherein said second portion includes one of curved track segments and straight track segments preceding a curved segment.

9. A toy vehicle racing game as claimed in claim 7, wherein said second portion includes both straight and curved track segments.

10. A toy vehicle racing game as claimed in claim 2 or 4, wherein said toy vehicle includes an electric motor and said rails are electrified, said electric motor being adpated to draw power from said rails, said electric motor being further adapted to drive at least a portion of said plurality of wheels for running on said track surface.

11. A toy vehicle racing game as claimed in claim 6, wherein said toy vehicle includes an electric motor and said rails are electrified, said electric motor being adpated to draw power from said rails, said electric motor being further adapted to drive at least a portion of said plurality of wheels for running on said track surface.

12. A toy vehicle racing game as claimed in claim 1, wherein said toy vehicle includes a shell, said shell being contoured in imitation of the contours of real or fanciful vehicles, said shell being tapered upwardly on the underside thereof forward of said front wheels and rearward of said rear wheels, whereby said transitional track segments are traveled without contact between said shell and said transitional track segments.

13. A toy vehicle racing game as claimed on claim 2, wherein said vehicle includes a pair of magnets, each magnet opposing one of said rails.

14. A toy vehicle racing game as claimed in claim 13, wherein said magnets are sized and positioned relative to said conductive rails of said first portion of said second plurality of track segments such that the attractive force between said vehicle and said conductive rails of said first portion of said second plurality of track segments is in the range 1.5 to 3.0 times the weight of said vehicle.

15. A toy vehicle racing game as claimed on claim 14, wherein said first portion of said second plurality of track segments has rails with about twice the thickness of said rails in said first plurality of segments, said reluctance varying inversely with said rail thickness.

16. A toy vehicle racing game as claimed in claim 15, wherein said rails in said first portion of said second plurality of track segments have a thickness in a range of 0.020 to 0.040 inch and a nominal rail height in a range of 0.012 to 0.020 inch.

17. A toy vehicle racing game as claimed in claim 13 or 16, wherein said magnets are a portion of said electric motor.

18. A toy vehicle racing game as claimed on claim 17, and further comprising flux collectors attached to said magnets and at least in part opposing the top surfaces of said conductive rails.

19. In a toy vehicle racing game including a track with magnetically permeable material connected thereto, and a miniature toy vehicle having a plurality of wheels for running on a surface of said track, said vehicle including magnetic means, said magnetic means being attracted to said permeable material of said track, the improvement therein comprising:

a first plurality and second plurality of track segments, said track segments being releasably joined together to form at least a portion of a closed loop track, the magnetic reluctance in a magnetic circuit including said magnetic means and said permeable material connected to said second plurality of track segments along essentially the length of each said segment being less than the magnetic reluctance of a similar magnetic circuit formed between said magnetic means and said permeable material connected to said first plurality of track segments along essentially the length of each said segment, the attraction between said vehicle and said track varying locally and inversely with said reluctances, the operating characteristics of the vehicle on the track varying locally in relation to the varying of said attraction.

20. A toy vehicle racing game as claimed in claim 19, wherein said track segments are one of straight and curved, and at least a portion of said curved track segments are in said second plurality.

21. A toy vehicle racing game as claimed in claim 19, wherein said track is comprised of both straight and curved segments, said second plurality including straight track segments, a straight track segment of said second plurality preceding a curved track segment in said at least a portion of a closed loop track.

22. A toy vehicle racing game as claimed in claim 19, 20 or 21, wherein said permeable material is in the form of rails on the running surface of said track segments, the cross-section of said rails in said first plurality of track segments differing from the cross-section of said rails in said second plurality of track segments, said magnetic path reluctance being related to the variations in said cross-section.

23. A toy vehicle racing game as claimed in claim 22, wherein the cross-sections between said first and second plurality of track segments differ in the width of said rails.

24. In a toy vehicle racing game including a track with magnetically permeable material connected thereto, and miniature toy vehicles having a plurality of wheels for running on a surface of said track, said vehicles including magnetic means, said magnetic means being attracted to said permeable material of said track, the improvement therein comprising:

a curved track segment having sufficient width of said surface for parallel running in a first inside lane and a second outside lane of a first and second of said vehicles thereon, the magnetic reluctance in a magnetic circuit including said permeable material in said first inside lane and said magnetic means in said first vehicle being less than the magnetic reluctance in a magnetic circuit including said permeable material in said second outside lane and said magnetic means in said first vehicle, the attraction between said vehicle and said track lanes being inversely related to the magnitudes of said reluctances, the vehicle drag being directly related to said attractive force, said first vehicle moving more slowly on said inside lane than on the outside lane when equally powered in said first and second lanes.

25. A toy vehicle racing game as claimed in claim 24, wherein said permeable material is at least in part in the form of rails connected to said track surface, the width of said rails in said first lane being greater than the width of said rails in said second lane, said magnetic circuit reluctance varying inversely to the width of said rails.

26. A toy vehicle racing game as claimed in claim 25, wherein said vehicles include an electric motor, power to said motor being transmitted through said rails.

27. A toy vehicle racing game as claimed in claim 26, wherein said magnetic means includes at least a magnet.

28. A toy vehicle racing game as claimed in claim 27, wherein the number of said magnets is at least two, at least two of said magnets being components of said electric motor.

29. A first segment and a second segment of track for a toy vehicle racing game, and adapted for use with a vehicle including magnetic means, comprising:

a non-conducting running surface, said segments being releasably connectable together, said running surface being continuous between said first and second segments when connected; magnetically permeable and electrically conductive rails connected to said running surface, said rails being electrically continuous between said connected track segments, said rails being attracted by said magnetic means to urge said vehicle against said track surface, rails connected to said first segment having a greater thickness along essentially their entire length than the rails connected to said second segment, said attraction being greater to said first segment, the attraction between said vehicle and said first segment being sufficient to normally hold the vehicle to the track during passage of the vehicle therealong if said first segment were disposed vertically.

30. A first segment and a second segment of track as claimed in claim 29, wherein said vehicle further includes an electrical motor and said rails are electrified for supplying power to said vehicle.

31. A first segment and a second segment of track as claimed in claim 30, and including a third segment of track having a non-conducting running surface and electrically conductive rails connected to said running surface, said third segment of track being connectable to said first and second segments so that the running surface thereof is continuous between said first, second and third segments when connected, and so that said rails of said first, second and third segments are electrically continuous when connected, said third segment being formed to define an essentially 90° transition of the running surface between an essentially horizontally extending direction and an essentially vertically extending direction.

* * * * *